US008742998B2

(12) United States Patent
Kuramoto

(10) Patent No.: US 8,742,998 B2
(45) Date of Patent: Jun. 3, 2014

(54) GOODS STORAGE TOOL AND CONNECTION METHOD

(75) Inventor: Akio Kuramoto, Tokyo (JP)

(73) Assignee: NEC Corporation, Tokyo (JP)

( * ) Notice: Subject to any disclaimer, the term of this patent is extended or adjusted under 35 U.S.C. 154(b) by 298 days.

(21) Appl. No.: 13/058,082

(22) PCT Filed: Aug. 27, 2009

(86) PCT No.: PCT/JP2009/064987

§ 371 (c)(1),
(2), (4) Date: Feb. 8, 2011

(87) PCT Pub. No.: WO2010/024347

PCT Pub. Date: Mar. 4, 2010

(65) Prior Publication Data

US 2011/0140976 A1 Jun. 16, 2011

(30) Foreign Application Priority Data

Aug. 28, 2008 (JP) ..... 2008-219859

(51) Int. Cl.
*H01Q 1/00* (2006.01)

(52) U.S. Cl.
USPC ..... 343/720; 343/878; 343/904

(58) Field of Classification Search
USPC ..... 343/720, 878, 904
See application file for complete search history.

(56) References Cited

U.S. PATENT DOCUMENTS

| | | | | | |
|---|---|---|---|---|---|
| 5,293,177 | A * | 3/1994 | Sakurai et al. | ..... | 343/906 |
| 2007/0268189 | A1 * | 11/2007 | Kuramoto et al. | ..... | 343/700 MS |
| 2008/0055083 | A1 * | 3/2008 | Yu | ..... | 340/571 |

FOREIGN PATENT DOCUMENTS

| | | | | | |
|---|---|---|---|---|---|
| JP | 63303522 | A | * 12/1988 | ..... | H04B 1/38 |
| JP | 1-64206 | A | 4/1989 | | |
| JP | 0164206 | | * 4/1989 | ..... | H01Q 1/12 |
| JP | 11-180545 | A | 7/1999 | | |
| JP | 2001119232 | A | 4/2001 | | |
| JP | 2003258520 | A | 9/2003 | | |
| JP | 2006309401 | A | 11/2006 | | |
| JP | 2009055328 | A | 3/2009 | | |

OTHER PUBLICATIONS

International Search Report for PCT/JP2009/064987 mailed Dec. 1, 2009.

* cited by examiner

*Primary Examiner* — Dameon Levi
*Assistant Examiner* — Collin Dawkins
(74) *Attorney, Agent, or Firm* — Sughrue Mion, PLLC

(57) ABSTRACT

An object is to provide a goods storage tool that enables an antenna to be connected to an electronics device without the need to take out the antenna from a storage object in which the antenna is stored. A goods storage tool of the present invention is a goods storage tool for storing goods or contents therein. The goods storage tool includes an antenna that is stored in the goods storage tool; and a connection portion that enables a feeder connector connected to an electronics device to be connected to the antenna in such a way that the antenna remains stored in the goods storage tool.

6 Claims, 9 Drawing Sheets

GOODS STORAGE TOOL AND CONNECTION METHOD

The present application is the National Phase of PCT/JP2009/064987, filed Aug 27, 2009, which is based on Japanese Patent Application No. 2008-219859 (filed on Aug. 28, 2008) and claims priority under the Paris Convention from Japanese Patent Application No. 2008-219859, the disclosed contents of which being incorporated herein by reference.

TECHNICAL FIELD

The present invention relates to a goods storage tool and particularly to a goods storage tool in which an antenna is provided.

BACKGROUND ART

In recent years, various outdoor wireless service systems, including the following, have become increasingly available: cellular phones, hot spot services for wireless LAN (Local Area Network), and WiMAX (Worldwide Interoperability for Microwave Access). In the broadcasting sector, digital terrestrial television broadcasting and the like have started. In order to make effective use of such various wireless services, the performance of antennas is important.

As communications technologies have advanced in recent years, small terminals, such as a cellular phone, PDA (Personal Digital Assistant) or laptop PC (Personal Computer), have been able to communicate at high speeds.

In a wireless communication process of such a terminal, radio waves are used. The terminal is usually equipped with an antenna. However, since the terminal is small in size, the terminal is, in many cases, equipped with a small antenna or small built-in antenna.

Meanwhile, it is known that as the antenna becomes physically larger, radiation efficiency and gain, which are important integrants in wireless communication, become better because of characteristics thereof.

The above-described small terminal device is generally equipped with only a small antenna. It is difficult to say that the performance of the antenna that the terminal device is equipped with is sufficiently high.

The problem is that it is not possible to obtain a sufficient receiving electric field needed for high-speed communication in a region where a radio wave propagation environment is not good, i.e. at a place where radio waves from a base station are weak. That is, the problem is that it is not possible to obtain sufficient S/N to perform high-speed communication.

To solve the problem, a relatively large external antenna is required. However, under the present circumstances, the problem is that it is difficult to store an existing external antenna in a bag or the like since the external antenna is three-dimensional and bulky.

If an antenna is stored in a goods storage tool such as a bag, it is necessary to take out the antenna from the bag and connect a coaxial cable to the antenna when the antenna is used.

Under such circumstances, the following are extremely useful: an antenna that can be easily stored in a goods storage tool such as a bag, and an electricity supply method that can be used without the antenna being taken out from the goods storage tool.

CITATION LIST

Patent Literature

{PTL 1} JP-A-2001-119232
{PTL 2} JP-A-2003-258520

{PTL 3} JP-A-2006-309401
{PTL 4} JP-A-11-180545

SUMMARY OF INVENTION

Technical Problem

In general, the following goods storage tools A1) to A7) do not function as an antenna or do not have a function of adding an antenna.

A1) A bag

A2) A soft or hard case in which a personal computer is stored, or a bag in which a personal computer is stored A3) A book wrapper A4) A goods storage case (hard or soft) for a PDA, portable printer, projector, or camcorder A5) A suitcase, knapsack, rucksack, golf bag A6) Other things that are similar to bags carried by hand A7) A stuffed toy, mascot or the like There is no hole for adding an antenna; there is no structure in which a portion of a feeder circuit is built.

Therefore, when an attempt is made to watch television away from home with the use of a portable device such as a small portable digital terrestrial television receiver, the problem is that it is impossible to watch in an area where radio waves are weak.

Under the present circumstances, existing antennas are three-dimensional and bulky; it is difficult to store the antennas in a bag or the like. When in use, the antenna needs to be taken out from a bag for connection.

To solve the problems, a relatively large external antenna is required. However, carrying the external antenna comes with the following problems.

(1) Under the present circumstances, existing external antennas are three-dimensional and bulky. Therefore, the problem is that when an external antenna is stored in a bag or the like, the outline becomes bumpy and it is difficult to store.

(2) If an external antenna is stored in a goods storage tool such as a bag, it is necessary to take out the external antenna from the bag and connect a coaxial cable to the external antenna when the antenna is used.

Therefore, an object of the present invention is to provide a goods storage tool that enables an antenna to be connected to an electronics device without the need to take out the antenna from a goods storage tool in which the antenna is stored.

According to the present invention, provided is a goods storage tool for storing goods or contents there, comprising: an antenna that is stored in the goods storage tool; and a connection portion that enables a feeder connector connected to an electronics device to be connected to the antenna in such a way that the antenna remains stored in the goods storage tool, wherein the connection portion includes a feeder terminal attached to the antenna and a junction metal part attached to an outer wrapper of the goods storage tool, wherein the feeder terminal and the junction metal part are electrically connected, and the junction metal part and the feeder connector are electrically connected, and wherein the feeder terminal and the junction metal part are detachably connected.

According to the present invention, provided is a connection method of connecting an antenna stored in a goods storage tool for storing goods or contents therein to an electronics device, the connection method comprising: a connection step of using a connection portion to connect a feeder connector connected to the electronics device to the antenna in such a way that the antenna remains stored in the goods storage tool, wherein the connection portion includes a feeder terminal attached to the antenna and a junction metal part attached to an outer wrapper of the goods storage tool, wherein at the connection step, the feeder terminal and the junction metal part are electrically connected, and the junction metal part and the feeder connector are electrically connected, and wherein the feeder terminal and the junction metal part are detachably connected.

Advantageous Effects of Invention

According to the present invention, it is possible to connect the antenna to an electronics device without the need to take out the antenna from a goods storage object in which the antenna is stored.

DESCRIPTION OF EMBODIMENTS

Figure 1:
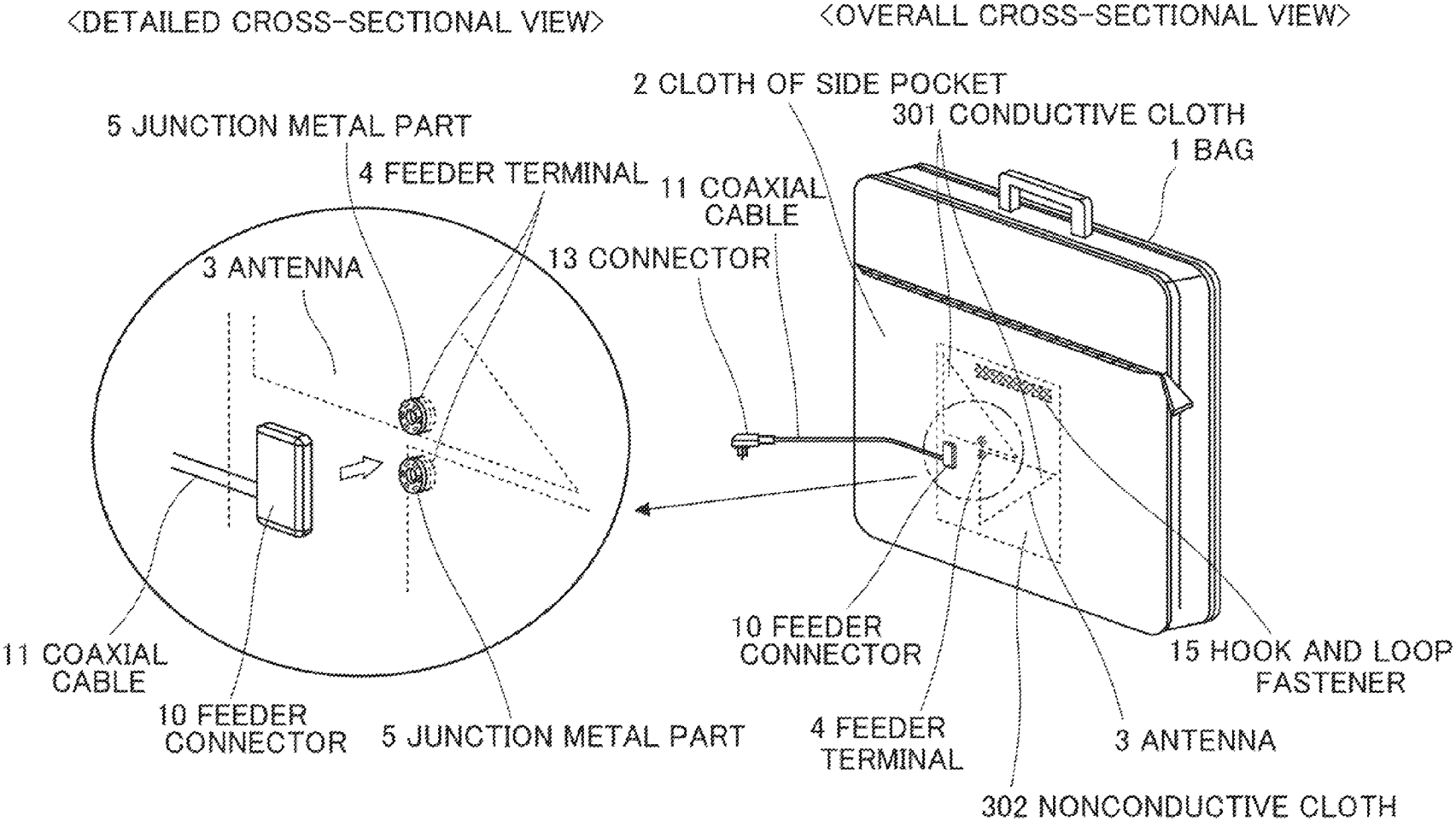
{FIG. 1} A diagram showing the configuration of a goods storage tool according to a first embodiment of the present invention.

Hereinafter, the best mode for carrying out the present invention will be described in detail with reference to the accompanying drawings.

1) The following are the antennas to be used: a small antenna that is not bulky, a planar antenna, .a flexible antenna made up of a FPC (Flexible Printed Circuit), film or the like, and an antenna made of conductive cloth or the like. Incidentally, when an antenna is made of conductive cloth or the like, the antenna, including a peripheral portion made of nonconductive cloth or the like, may be referred to as an antenna. When such an antenna is stored in a goods storage tool, feeder terminals 4 and 12 are provided to connect the antenna and an electronics device. Junction metal parts 5 are also provided to connect the feed terminals 4 and 12 so that the antenna and the electronics device are connected together. The junction metal parts 5 are so formed as to enable an external coaxial cable 11 to be connected from the outside.

2) When the antenna that is to be used is stored in a goods storage tool, holes are made on a portion, over feeder terminals, of the cloth of the side pocket.

In this manner, the feeder terminals are so formed as to enable an external coaxial cable to be connected from the outside.

Thanks to the above configuration 1) or 2), the convenience to be obtained is that it is possible to use the antenna stored in the goods storage tool when the antenna is connected without the need to take out the antenna from the goods storage tool (The convenience to be obtained is that it is possible to connect a feeder line to an antenna 3 and use the antenna 3 without the need to take out the antenna 3 from the goods storage tool).

In particular, when the antenna 3 is stored in a side pocket of a bag 1 (see FIG. 1), the antenna 3 has the advantage of being in surroundings where radio waves can be easily received.

A goods storage tool of the present invention may be so formed that the antenna 3 can be attached to the goods storage tool; alternatively, the goods storage tool may have a function of the antenna 3.

According to the present invention, the expected specific examples are as follows:

A1) A bag

A2) A soft or hard case in which a personal computer is stored, or a bag in which a personal computer is stored A3) A book wrapper A4) A goods storage case (hard or soft) for a PDA, portable printer, projector, or video A5) A suitcase, knapsack, rucksack, golf bag A6) Other things that are similar to bags carried by hand A7) A stuffed toy, mascot or the like For the above expected objects, the following functions are included:

B1) In addition to the above original functions A1) to A6), what is included is a structure in which the antenna 3 can be mounted; alternatively, it is possible to mount the antenna 3, and a portion of a feeder terminal thereof is incorporated.

B2) The antenna 3 can be removed or mounted when needed.

B3) It is possible to use the antenna 3, which can be attached to the goods storage tool of the present invention, for a device that can receive digital terrestrial television or digital radio, cellular phone, portable terminal, PDA, personal computer or the like.

B4) The related technical fields of the attachable antenna 3 include techniques of diversity and MIMO (Multiple Input Multiple Output). The related systems include a cellular phone, wireless LAN, WiMAX, LTE (Long Time Evolution), and the fourth generation mobile communication.

FIG. 1 is a diagram showing the configuration of a goods storage tool according to a first embodiment of the present invention. On a side face of a bag 1, a side pocket is provided. A surface of the bag 1 is covered with the cloth 2 of the side pocket (i.e. outer wrapper).

In the side pocket, an antenna 3 is stored. The antenna 3 has feeder terminals 4 that have the structure of a metallic snap button or eyelet.

On the cloth 2 of the side pocket, at the locations of the feeder terminals 4 of the antenna 3, junction metal parts 5 are disposed: the junction metal parts 5 are made of a conductor. The junction metal parts 5 pierce through the cloth of the side pocket from the inside to the outside of the side pocket's cloth. From the inside, the feeder terminals 4 can be put into the junction metal parts 5. From the outside, a feeder connector 10 can be put into the junction metal parts 5.

Figure 2:
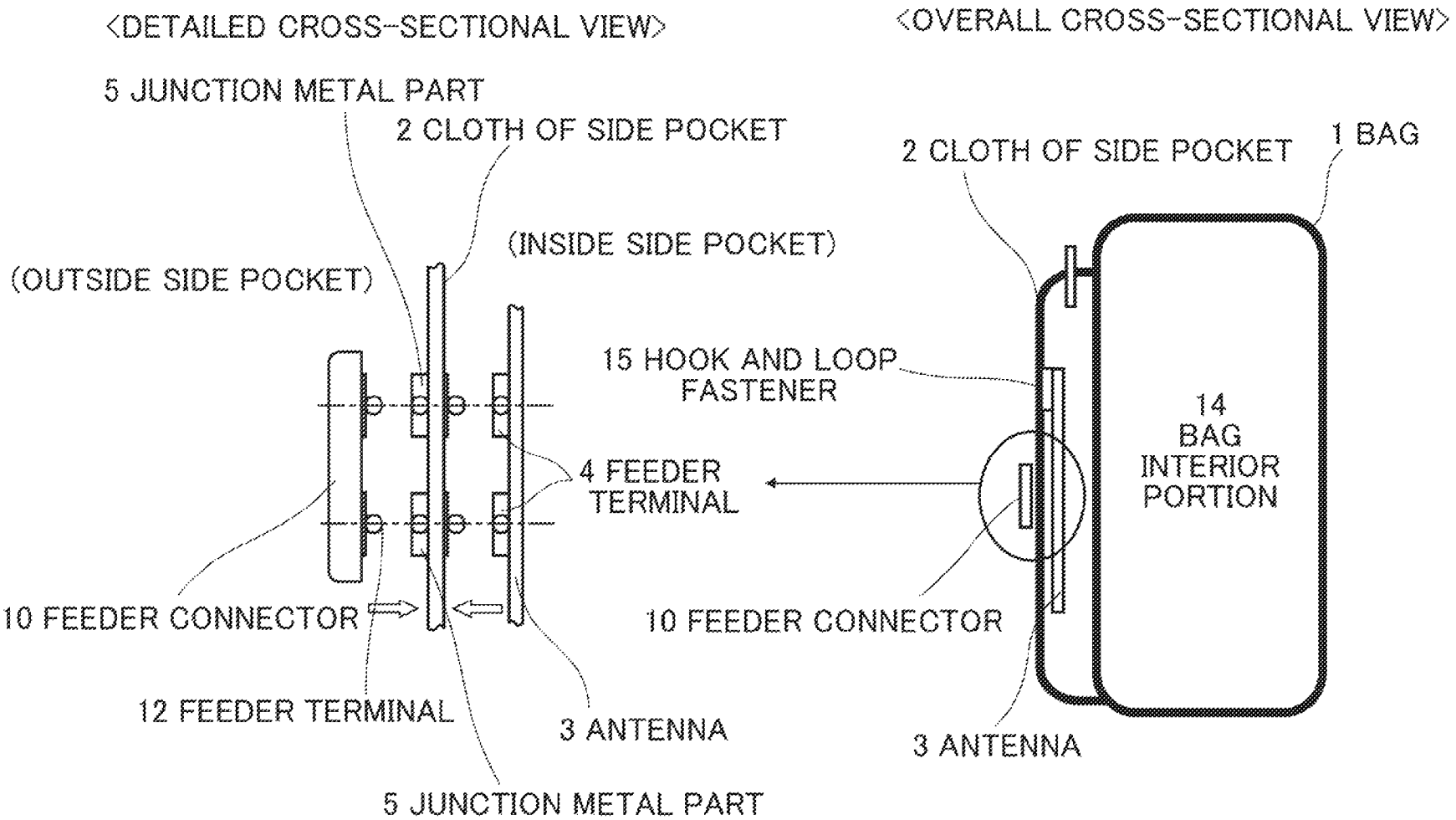
{FIG. 2} A cross-sectional view of peripheral portions of junction metal parts according to the first embodiment of the present invention.

As shown in FIGS. 1 and 2, one end of a coaxial cable 11 is connected to the feeder connector 10. A connector 13 is connected to the other end of the coaxial cable 11. When the feeder connector 10 is connected to the junction metal parts 5 and when a radio device or the like is connected to the connector 13, the antenna 3 is connected to the radio device or the like for use.

Figure 3:
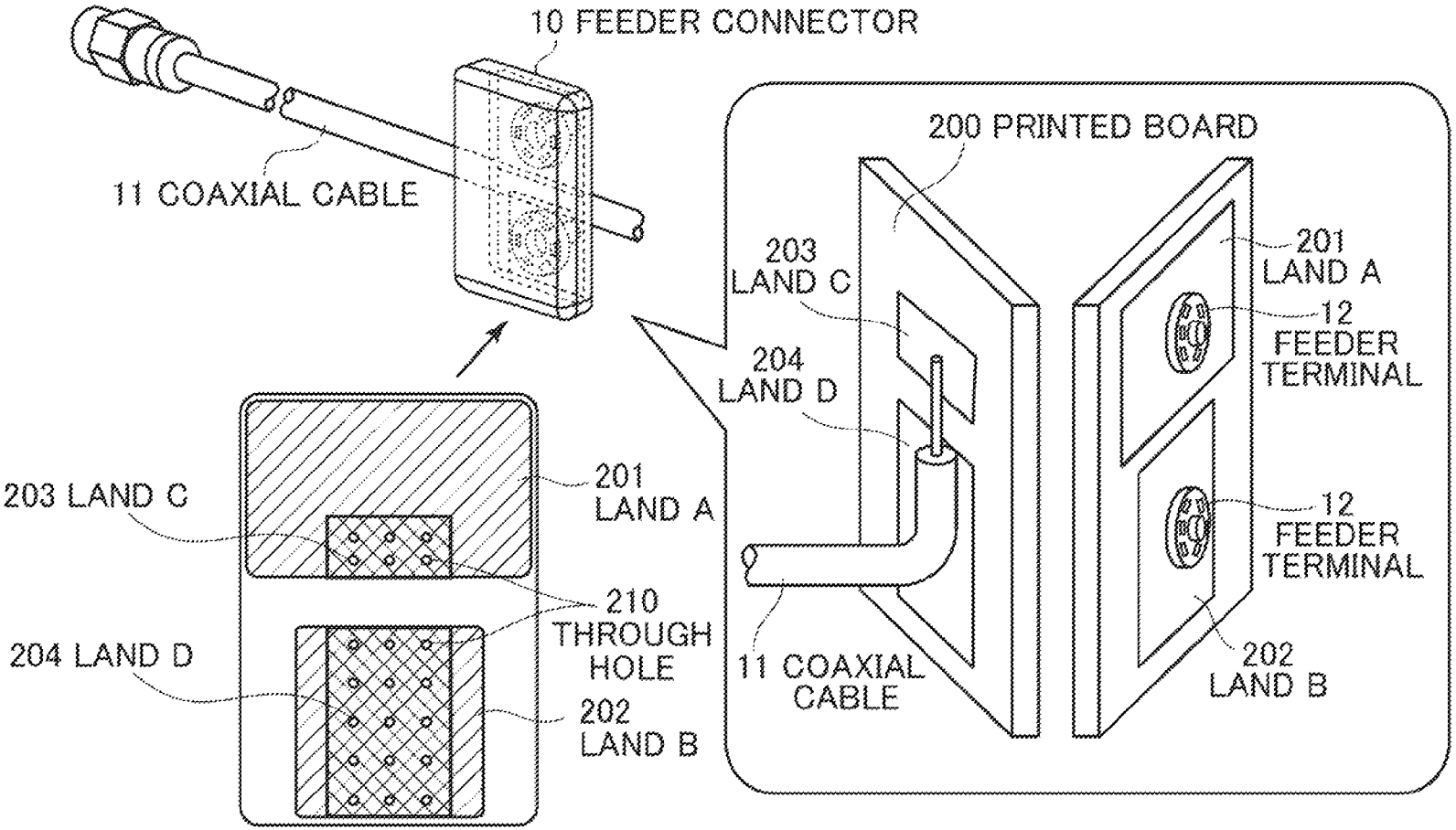
{FIG. 3} A diagram showing in detail the configuration of a feeder connector according to the first embodiment of the present invention.

FIG. 3 shows in detail the configuration of the coaxial cable 11 and the feeder connector 10 according to one example.

In the feeder connector 10, a printed board 200 is disposed. On one side of the printed board 200, a land A 201 and a land B 202, which are copper-foil patterns, are disposed. On the other side, a land C 203 and a land D 204, which are copper-foil patterns, are disposed.

The land A 201 and the land C 203 are connected together via a plurality of through holes 210 in a way that obtains a sufficient electrical conduction in terms of high-frequency waves; the land B 202 and the land D 204 are connected together via a plurality of through holes 210 in a way that obtains a sufficient electrical conduction in terms of high-frequency waves.

Feeder terminals 12 are soldered to the land A 201 and the land B 202. A coaxial center conductor and coaxial external conductor of the coaxial cable 11 are connected to the land C 203 and the land D 204, respectively.

Incidentally, the antenna 3 includes two triangular pieces of conductive cloth 301 and a square piece of nonconductive cloth 302, which is positioned around the triangular pieces of conductive cloth 301. The first feeder terminal 4 is attached to the first piece of conductive cloth 301, and the second feeder terminal 4 to the second piece of conductive cloth 301. The first feeder terminal 4 is connected to the center conductor of the coaxial cable 11 via the first junction metal part 5 and the feeder connector 10. The second feeder terminal 4 is connected to the conductor of an outer-skin portion of the coaxial cable 11 via the second junction metal part 5 and the feeder connector 10.

FIG. 2 is a cross-sectional view of peripheral portions of the junction metal parts 5 according to the first embodiment. In the overall cross-sectional view, a cross section of the bag 1 is shown. It is clear that inside the cloth 2 of the side pocket of the bag 1, the antenna 3 is stored. The antenna 3 is electrically connected to a radio device or the like outside the cloth 2 of the side pocket via the feeder terminals 4, the feeder connector 10, the coaxial cable 11 and the connector 13.

What is shown in the detailed cross-sectional view is a connection relationship between the feeder terminals 4 of the antenna 3, the junction metal parts 5, and the feeder terminals 12 that are added to the feeder connector 10.

The junction metal parts 5 include metallic joining portions on both sides of the cloth 2 of the side pocket. Inside the side pocket 2, the joining portions are put into the feeder terminals 4 of the antenna 3; outside the cloth 2 of the side pocket, the feeder terminals 12 that are added to the feeder connector 10 are put into the joining portions. As a result, the feeder terminals 4 are connected to the feeder terminals 12 through the junction metal parts 5.

Incidentally, if the antenna 3 is fixed on the cloth 2 of the side pocket with a hook and loop fastener 15, it is possible to prevent the antenna 3 from coming off in the side pocket. With the use of the hook and loop fastener 15, the antenna 3 may be fixed at one point or at a plurality of points.

As a method of fixing the antenna 3, a method of fixing the antenna 3 with typical buttons or another method may be also used.

Therefore, with the configuration shown in FIGS. 1 and 2, the antenna 3 is stored in the side pocket of the bag; it is possible to connect the coaxial cable 11 to the antenna 3 from the outside without the need to take out the antenna 3 from the side pocket.

Incidentally, in the case of FIG. 2, if there is no side pocket on the bag that is to be used and if there is only a major bag interior portion 14, a structure that is similar to the above may be provided on a side face of the bag interior portion 14 so that similar advantages can be achieved.

Figure 4:
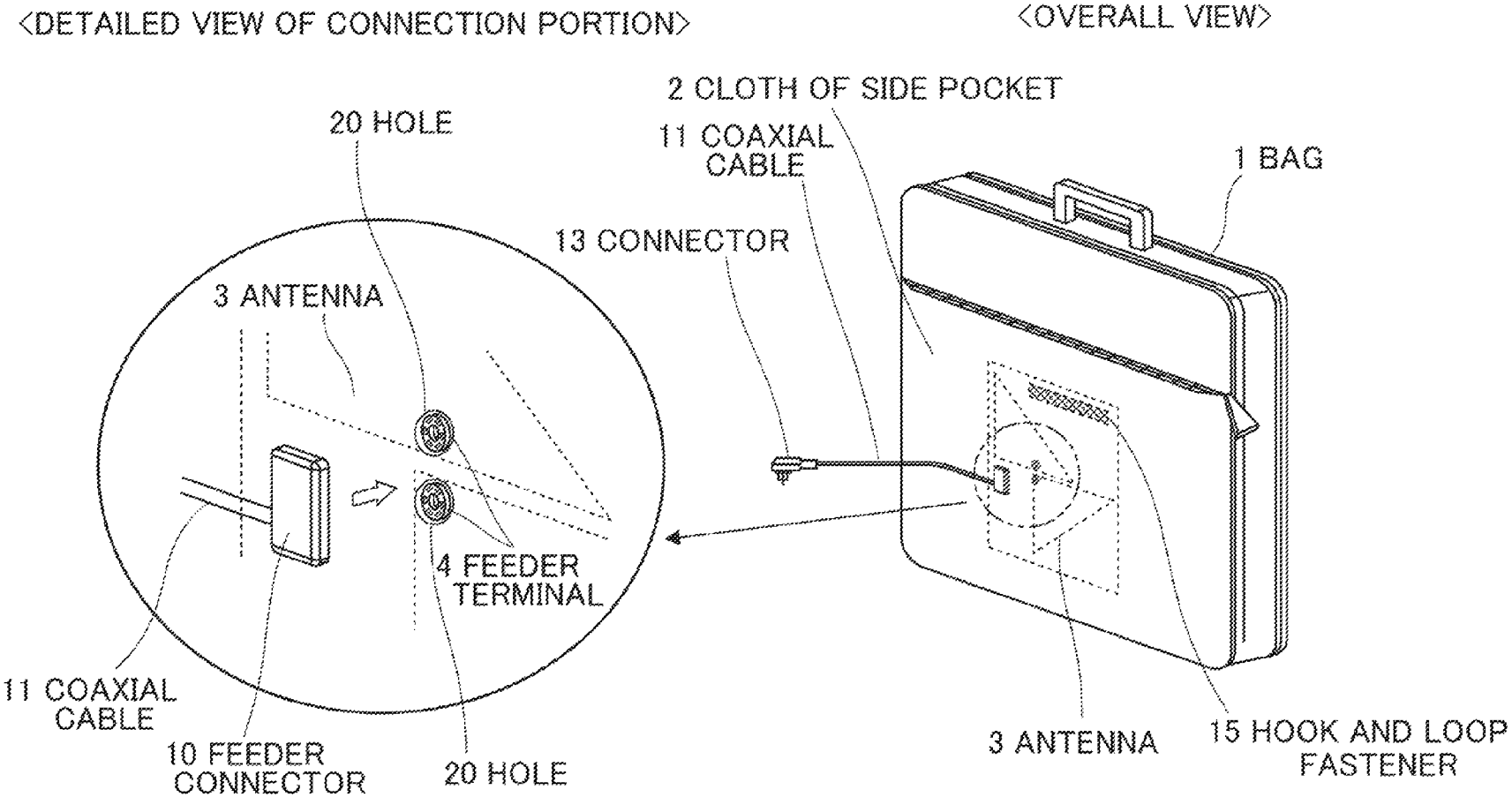
{FIG. 4} A diagram showing the configuration of a goods storage tool according to a second embodiment of the present invention.

FIG. 4 is a diagram showing the configuration of a goods storage tool according to a second embodiment of the present invention. As in the case of FIG. 1, an antenna 3 is stored in a side-face side pocket of a bag 1. The difference from that shown in FIGS. 1 and 2 is that, as shown in the detailed view of a connection portion, holes 20 are provided so that a feeder connector 10 can be connected to portions of feeder terminals 4 from the outside.

It is possible to connect the feeder connector 10 to the feeder terminals 4 through the holes 20 from the outside.

Figure 5:
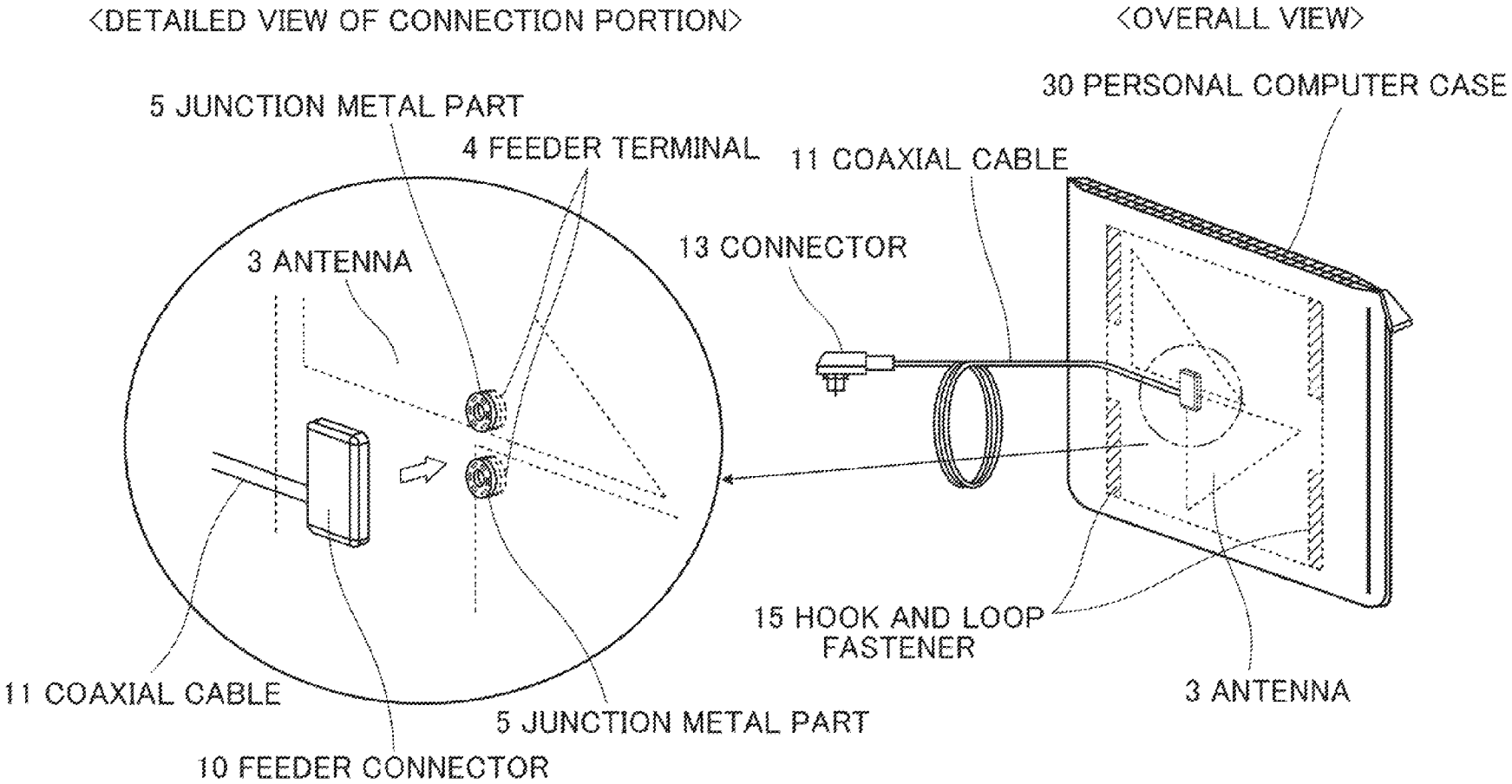
{FIG. 5} A diagram showing the configuration of a goods storage tool according to a third embodiment of the present invention.
Figure 6:
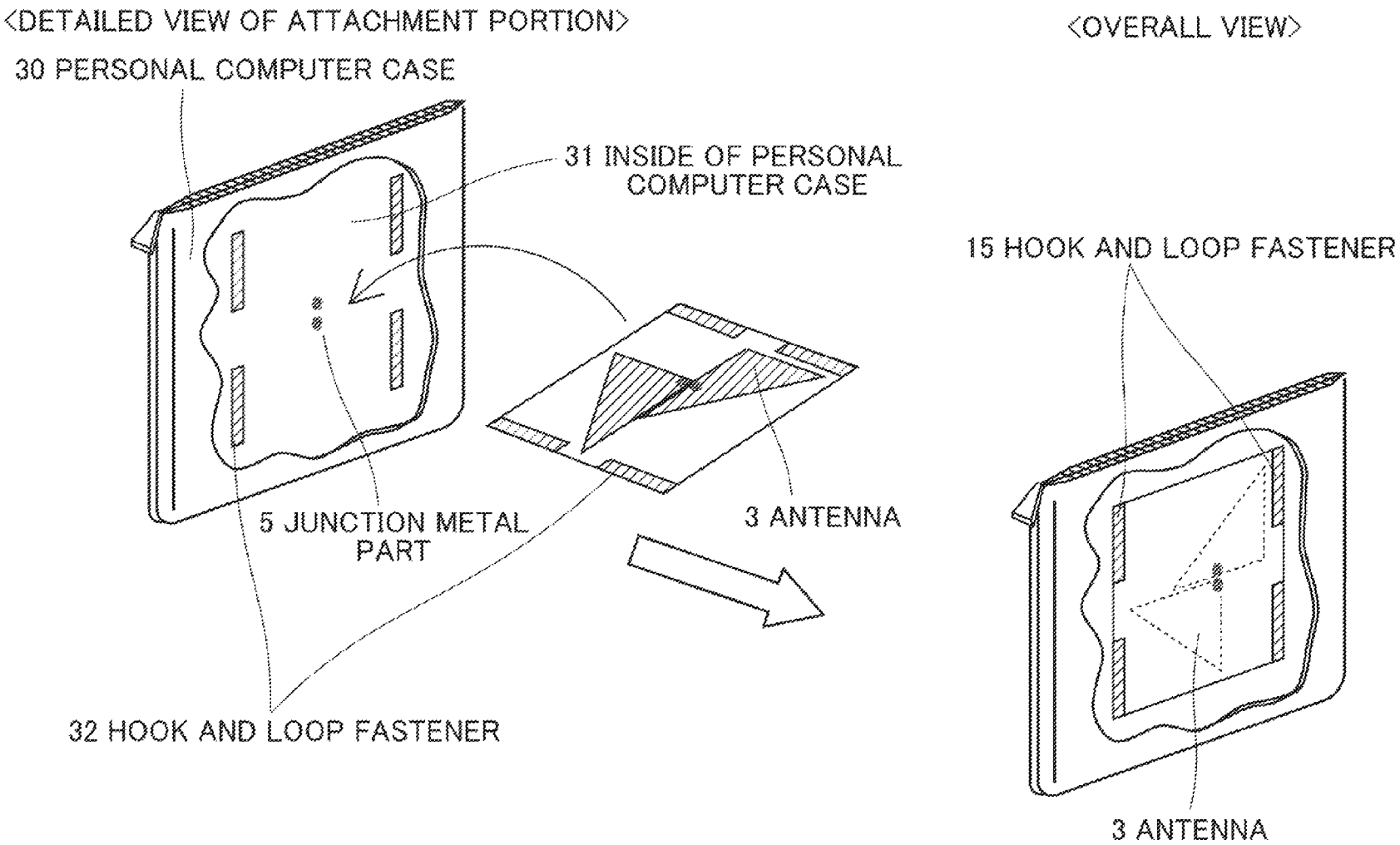
{FIG. 6} A diagram showing in detail the configuration of an interior portion according to the third embodiment of the present invention.

FIG. 5 is a diagram showing the configuration of a goods storage tool according to a third embodiment of the present invention. FIG. 6 shows a connection structure in the goods storage tool. The embodiment shown in FIGS. 5 and 6 is different from that shown in FIGS. 1 and 2 in that a target goods storage tool is a personal computer case 30.

As in the case of FIGS. 1 and 2, in the personal computer case 30, an antenna 3 is disposed and fixed with a hook and loop fastener 15. As shown in the detailed view of a connection portion, feeder terminals 4 of the antenna 3 are connected to junction metal parts 5 that are disposed on a side face of the personal computer case 30. Furthermore, the junction metal parts 5 are connected to a feeder connector 10, which is to be connected from the outside. The above connection structure is similar to the connection structure shown in FIG. 2, which is a detailed cross-sectional view.

Figure 7:
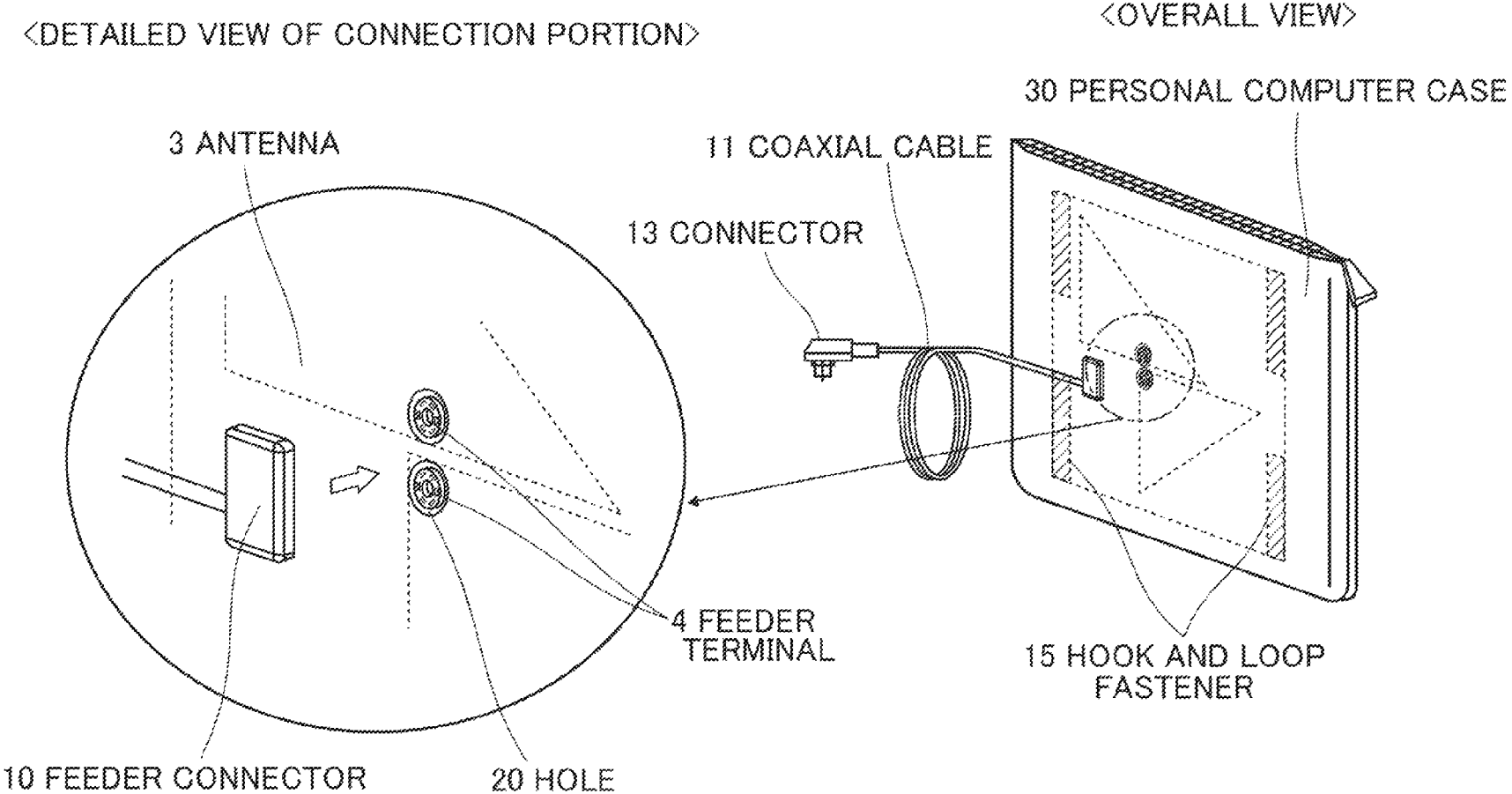
{FIG. 7} A diagram showing the configuration of a goods storage tool according to a fourth embodiment of the present invention.

FIG. 7 is a diagram showing the configuration of a goods storage tool according to a fourth embodiment of the present invention. The fourth embodiment is different from the embodiment shown FIGS. 5 and 6 in that feeder terminals 4 are directly connected to a feeder connector 10 via holes 20. The difference is similar to that between the second embodiment shown in FIG. 4 and the first embodiment shown in FIGS. 1 and 2.

Figure 8:
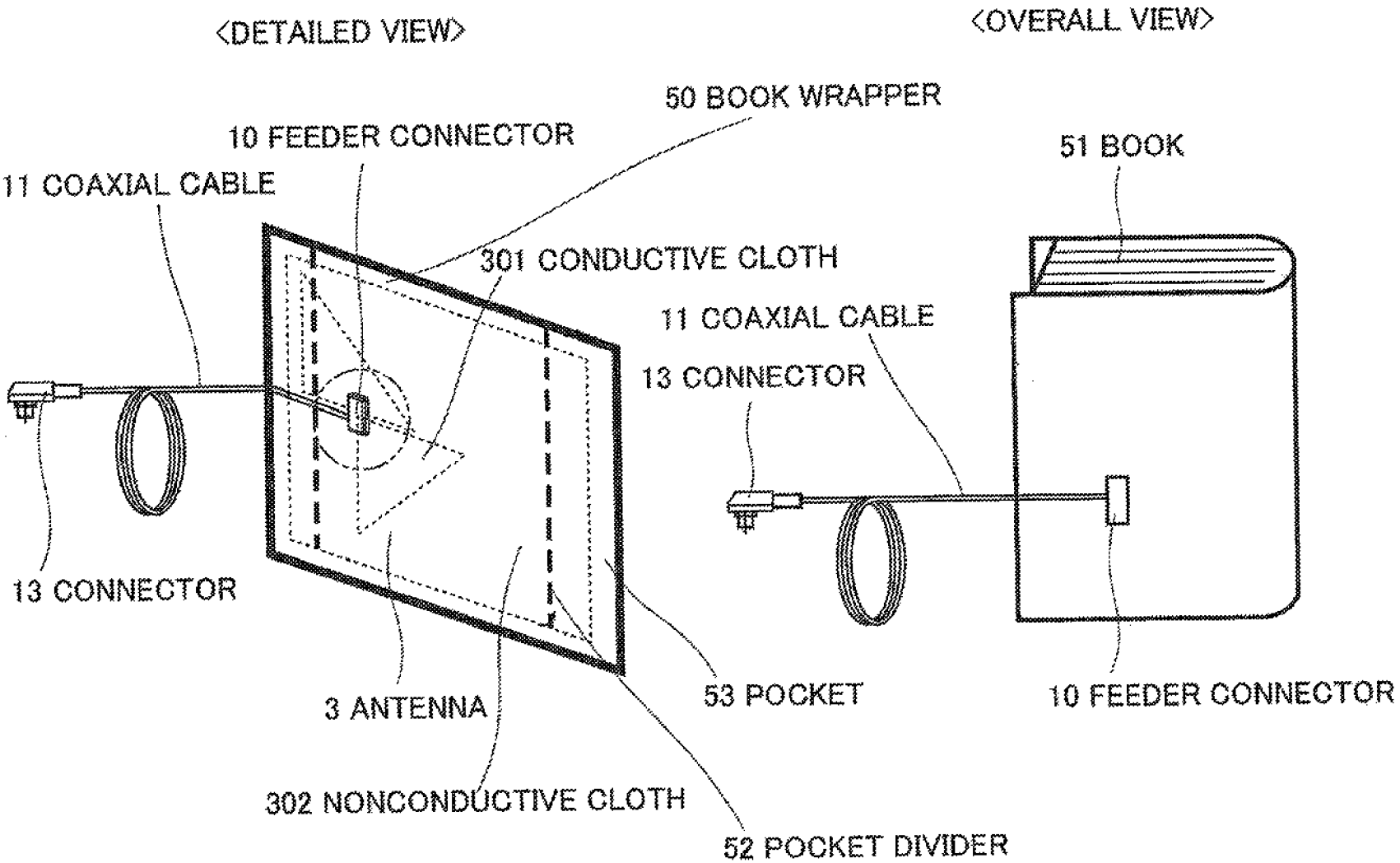
{FIG. 8} A diagram showing the configuration of a goods storage tool according to a fifth embodiment of the present invention.
Figure 9:
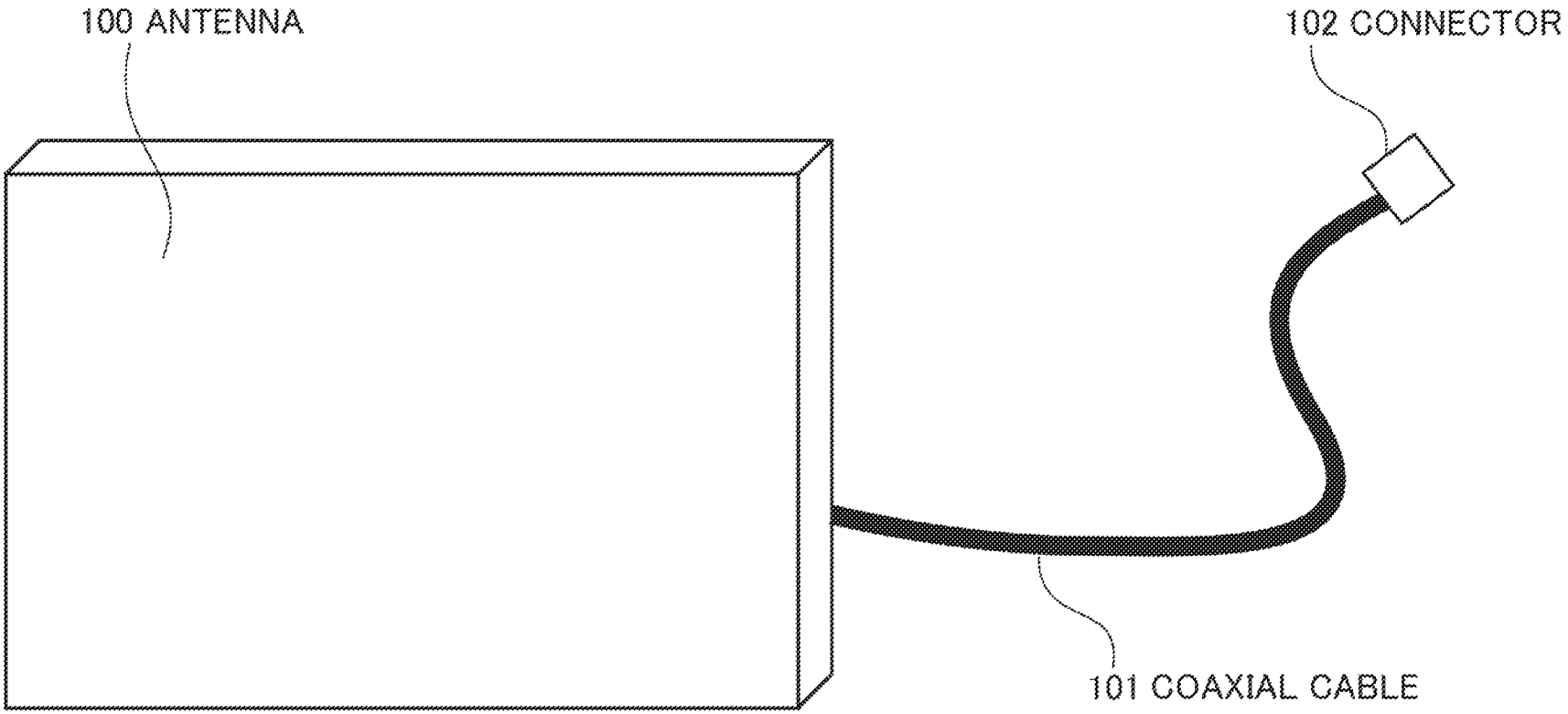
{FIG. 9} An example of a typical technology.

FIG. 8 is a diagram showing the configuration of a goods storage tool according to a fifth embodiment of the present invention. The fifth embodiment is different from the embodiments shown in FIGS. 1 and 4 in that a target goods storage tool is a book wrapper 50.

The book wrapper 50 is used to cover a book 51 (i.e. as outer wrapper). The book may be replaced with a notebook, binder, catalogue, or the like. The book wrapper 50 may be replaced with a case for storing documents (a storage tool that uses a plastic case, vinyl, or the like to store documents; a safekeeping tool; or the like).

If the book wrapper 50 is a goods storage tool, the book 51 is generally fixed after the cover portions of the book are put into pockets 53 through dividers 52 of the pockets. Therefore, an end of an antenna 3 may be fixed in advance after being put into the pocket 53 through the divider 52 of the pocket. That is, both ends of a portion of a square piece of nonconductive cloth 302, indicated by fine dashed line in FIG. 8, are fixed after being put into the pockets 53.

As a method of connecting the feeder connector 10 to the antenna 3, there is a method of connecting the feeder connector 10 to the antenna 3 using the junction metal parts 5 as shown in FIG. 2, which is a detailed cross-sectional view, as well as a method of connecting the feeder connector 10 to the antenna 3 using the holes 20 as shown in FIG. 4.

Even if any method is used, it is possible to store the antenna 3 in the book wrapper 50; it is possible to connect a coaxial cable 10 from the outside of the book wrapper 50 without the need to take out the antenna 3 from the book wrapper 50.

Incidentally, the goods storage tools to which the present invention is applied include not only a bag, a soft case in which a personal computer is stored, a hard case in which a personal computer is stored, a bag in which a personal computer is stored, and a book wrapper, but also a storage case for a PDA, a storage case for a portable printer, a storage case for a projector, a storage case for a camcorder, a suitcase, a knapsack, a rucksack, a golf bag, and other things that are similar to bags carried by hand.

Furthermore, in terms of those to which the present invention can be applied, the goods storage tools include a stuffed toy, mascot or the like in which the antenna 3 can be stored.

Although the exemplary embodiments of the present invention have been described in detail, it is to be understood that various changes, substitutions and alternatives are possible without departing from the spirit and scope of the invention as defined in the claims. Even if the claims are corrected in a filing process, the inventor intends the range of equivalency of the claims of the invention to be maintained.

INDUSTRIAL APPLICABILITY

The present invention can be used to connect a large antenna to a small electronics device without bothering a user.

REFERENCE SIGNS LIST

1: Bag
2: Cloth of side pocket
3: Antenna
4: Feeder terminal
5: Junction metal part
10: Feeder connector
11: Coaxial cable
12: Feeder terminal
13: Connector
15: Hook and loop fastener
20: Hole
30: Personal computer case
31: Interior portion of personal computer case
32: Hook and loop fastener
51: Book
53: Pocket
50: Book wrapper
301: Conductive cloth
302: Nonconductive cloth

The invention claimed is:

1. A goods storage tool for storing goods or contents therein, comprising:

an antenna that is stored in the goods storage tool; a feeder terminal attached to the antenna, the feeder terminal being stored in the goods storage tool, and a junction metal part that pierces an outer wrapper of the goods storage tool, wherein in the junction metal part includes a joining portion at an inner side of the outer wrapper and another joining portion at an outer side of the outer wrapper, and wherein the joining portion at an inner side of the outer wrapper is detachably put into the feeder terminal for ohmic connection therebetween, and a feeder connector connected to a coaxial cable at an outer side of the outer wrapper is detachably put into the another joining portion at an outer side of the outer wrapper for ohmic connection therebetween.

2. The goods storage tool according to claim 1, wherein the goods storage tool is any one of a bag, a personal computer case, a book wrapper, a suitcase, a knapsack, a rucksack, a golf bag, a stuffed toy, and a mascot.

3. The goods storage tool according to claim 1, wherein what is used as the antenna is any one of a small antenna that is not bulky, a planar antenna, a flexible antenna made up of a Flexible Printed Circuit, film, and an antenna made of conductive cloth.

4. A connection method of connecting an antenna stored in a goods storage tool for storing goods or contents therein to a coaxial cable, the connection method comprising:

a connection step of using a junction metal part to connect a feeder connector connected to the coaxial cable —to the antenna in such a way that the antenna remains stored in the goods storage tool, the junction metal part piercing an outer wrapper of the goods storage tool, wherein a feeder terminal is attached to the antenna, the feeder terminal being stored in the goods storage tool, wherein the junction metal part includes a joining portion at an inner side of the outer wrapper and another joining portion at an outer side of the outer wrapper, and wherein the joining portion at an inner side of the outer wrapper is detachably put into the feeder terminal for ohmic connection therebetween, and a feeder connector connected to a coaxial cable at an outer side of the outer wrapper is detachably put into the another joining portion at an outer side of the outer wrapper for ohmic connection therebetween.

5. The connection method according to claim 4, wherein the goods storage tool is any one of a bag, a personal computer case, a book wrapper, a suitcase, a knapsack, a rucksack, a golf bag, a stuffed toy, and a mascot.

6. The connection method according to claim 4, wherein what is used as the antenna is any one of a small antenna that is not bulky, a planar antenna, a flexible antenna made up of a Flexible Printed Circuit, a film, and an antenna made of conductive cloth.

* * * * *